US011094252B2

(12) United States Patent
Lin et al.

(10) Patent No.: US 11,094,252 B2
(45) Date of Patent: Aug. 17, 2021

(54) DISPLAY-DRIVING METHOD AND A DISPLAY APPARATUS

(71) Applicant: BOE Technology Group Co., Ltd., Beijing (CN)

(72) Inventors: Yicheng Lin, Beijing (CN); Yu Wang, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 91 days.

(21) Appl. No.: 16/616,967

(22) PCT Filed: Jun. 22, 2018

(86) PCT No.: PCT/CN2018/092379

§ 371 (c)(1),
(2) Date: Nov. 25, 2019

(87) PCT Pub. No.: WO2019/037532

PCT Pub. Date: Feb. 28, 2019

(65) Prior Publication Data

US 2020/0168150 A1 May 28, 2020

(30) Foreign Application Priority Data

Aug. 21, 2017 (CN) ..... 201710718978.5

(51) Int. Cl.

| | |
|---|---|
| ***G09G 3/30*** | (2006.01) |
| ***G09G 3/3233*** | (2016.01) |
| ***G09G 3/3258*** | (2016.01) |

(52) U.S. Cl.

CPC ..... *G09G 3/3233* (2013.01); *G09G 3/3258* (2013.01); *G09G 2300/0819* (2013.01); *G09G 2300/0842* (2013.01); *G09G 2320/045* (2013.01); *G09G 2330/021* (2013.01)

(58) Field of Classification Search

None

See application file for complete search history.

(56) References Cited

U.S. PATENT DOCUMENTS

2006/0208971 A1* 9/2006 Deane ..... G09G 3/3233 345/76

2010/0164931 A1* 7/2010 Lin ..... G09G 3/3233 345/211

* cited by examiner

*Primary Examiner* — Carl Adams

(74) *Attorney, Agent, or Firm* — Intellectual Valley Law, P.C.

(57) ABSTRACT

The present application discloses a display-driving method and a display apparatus. The method includes performing an internal compensation to a driving transistor within a display-driving circuit for light-emission in a display-driving time per scan cycle and additionally performing an external compensation via an external-control-sub-circuit in a blanking time between two scan cycles. The method includes using the compensation-control sub-circuit to input a reference voltage to make a driving transistor in conduction state in s start period of the blanking time and increase a voltage level on a sense line associated with the display-driving circuit in an external-compensation period. The method further includes reading the voltage on the sense line at an end of the external-compensation period as a compensation voltage. Furthermore, the method includes using the external-control sub-circuit to correct a data voltage to be supplied to a data line based on the compensation voltage.

16 Claims, 4 Drawing Sheets

DISPLAY-DRIVING METHOD AND A DISPLAY APPARATUS

CROSS-REFERENCE TO RELATED APPLICATION

This application is a national stage application under 35 U.S.C. § 371 of International Application No. PCT/CN2018/092379, filed Jun. 22, 2018, which claims priority to Chinese Patent Application No. 201710718978.5, filed Aug. 21, 2017, the contents of which are incorporated by reference in the entirety.

TECHNICAL FIELD

The present invention relates to display technology, more particularly, to a display-driving method, and a display apparatus implementing the method.

BACKGROUND

Active-matrix organic light emitting diode (AMOLED) displays typically use oxide thin-film based driving transistor in its display-driving circuit for driving a light emitter per subpixel to emit light for displaying images. Fundamentally, the oxide thin-film transistor has a problem of large threshold voltage drift upon process variation, life time, and environmental change. Certain compensation mechanism is needed for preventing the drift to cause non-uniformity issue in the displayed image. Many approaches of compensation internally through various designs of the display-driving circuit do not provide satisfied results, demanding extra external electrical compensations. Therefore, improved display-driving method is desired for perfecting both internal and external compensation to the drift variations of driving transistors to enhance image quality of the AMOLED display.

SUMMARY

In an aspect, the present disclosure provides z display-driving method for a light-emitting display apparatus. The light-emitting display apparatus includes a driving integrated circuit (IC) and a display-driving circuit. The display-driving circuit includes a driving transistor having a first electrode coupled to a first power input port and a second electrode coupled to a first electrode of a light emitter. The display-driving circuit further includes a data-input sub-circuit coupled to a data line, a display scan line, and a gate electrode of the driving transistor. Additionally, the display-driving circuit includes a storage capacitor coupled between the gate electrode and the second electrode of the driving transistor. Furthermore, the display-driving circuit includes a compensation-switch sub-circuit coupled to the second electrode of the driving transistor, a sense line, and a compensation scan line. The driving IC includes a compensation-control sub-circuit coupled to the second electrode of the driving transistor, the sense line, and the data line. The display-driving method includes setting a start period followed by an external-compensation period within a blanking time between two scan cycles respectively for displaying two frames of image. In the start period, the display-driving method further includes supplying a first scan signal at a turn-off voltage level to the display scan line to disconnect the gate electrode of the driving transistor from the data line via the data-input sub-circuit. Additionally, the display-driving method includes supplying a second scan signal at a turn-on voltage level to the compensation scan line to connect the second electrode of the driving transistor to the sense line via the compensation-switch sub-circuit. Moreover, the display-driving method includes inputting a reference voltage via the compensation-control sub-circuit to the second electrode of the driving transistor to make the driving transistor in a conduction state.

Optionally, in the external-compensation period, the display-driving method includes supplying the first scan signal at the turn-off voltage level to the display scan line to disconnect the gate electrode of the driving transistor from the data line via the data input sub-circuit. The display-driving method further includes supplying the second scan signal at the turn-on voltage level to the compensation scan line to connect the second electrode of the driving transistor to the sense line via the compensation-switch sub-circuit. Additionally, the display-driving method includes making the second electrode of the driving transistor to a floating state via the compensation-control sub-circuit while keeping the driving transistor in the conduction state. Furthermore, the display-driving method includes charging the storage capacitor from the first power voltage port via the driving transistor in the conduction state so that a voltage level on the sense line increases as a voltage level at the second electrode of the driving transistor increases. Moreover, the display-driving method includes reading the voltage level on the sense line at an end of the external-compensation period as a compensation voltage for correcting a data voltage on the data line by the compensation-control sub-circuit.

Optionally, the display-driving method further includes comparing the compensation voltage with a preset emission-driving voltage by the compensation-control sub-circuit to obtain a voltage difference. Additionally, the display-driving method includes correcting the data voltage on the data line based on the voltage difference by the compensation-control sub-circuit.

Optionally, the blanking time further includes a compensation-reset period after the external-compensation period. The display-driving method in the compensation-reset period further includes supplying the first scan signal at the turn-off voltage level to the display scan line to disconnect the gate electrode of the driving transistor from the data line via the data input sub-circuit. Additionally, the display-driving method includes supplying the second scan signal at the turn-off voltage level to the compensation scan line to disconnect the second electrode of the driving transistor from the sense line via the compensation-switch sub-circuit.

Optionally, the display-driving method in the compensation-reset period further includes inputting the reference voltage via the compensation-control sub-circuit to the second electrode of the driving transistor and the sense line.

Optionally, each scan cycle includes a display-driving time including an internal-compensation period followed by an emission period. The display-driving method in the internal-compensation period further includes initializing a voltage level at the second electrode of the driving transistor to the reference voltage; supplying the first scan signal at the turn-on voltage level to the display scan line to connect the gate electrode of the driving transistor to the data line via the data-input sub-circuit; inputting a data voltage on the data line for displaying a current frame of image to the gate electrode of the driving transistor to make the driving transistor at a conduction state; supplying the second scan signal at the turn-off voltage level to the compensation scan line to disconnect the second electrode of the driving transistor from the sense line via the compensation-switch sub-circuit to make the second electrode of the driving transistor at a floating state; and charging the storage capacitor from the first power input port via the driving transistor in the conduction state to change a voltage level at the second electrode of the driving transistor to be a sum of the reference voltage and an internal-compensation voltage. The display-driving method in the emission period further includes supplying the first scan signal at the turn-off voltage level to the display scan line to disconnect the gate electrode of the driving transistor from the data line via the data-input sub-circuit to make the gate electrode of the driving transistor to a floating state; supplying a second scan signal at the turn-off voltage level to the compensation scan line to disconnect the second electrode of the driving transistor from the sense line via the compensation-switch sub-circuit to make the second electrode of the driving transistor at the floating state; maintaining a voltage difference across the storage capacitor a constant so that the driving transistor is at the conduction state with a gate-source voltage of the driving transistor being set to a difference between the data voltage and the sum of the reference voltage and the internal-compensation voltage; and driving the light emitter to emit light based on a driving current determined by the driving transistor having the gate-source voltage.

Optionally, the display-driving time further includes a display-reset period before the internal-compensation period. The display-driving method in the display-reset period further includes setting a voltage level at the second electrode of the driving transistor at the reference voltage; supplying the second scan signal at the turn-on voltage level to the compensation scan line to connect the second electrode of the driving transistor to the sense line via the compensation-switch sub-circuit to make a voltage level on the sense line equal to the reference voltage; supplying the first scan signal at the turn-on voltage level to the display scan line to connect the gate electrode of the driving transistor to the data line via the data-input sub-circuit; initializing the data line with the reference voltage; increasing a voltage level on the data line from the reference voltage to a first data voltage indented for displaying a current frame of image; and transferring the first data voltage to the gate electrode of the driving transistor to make the driving transistor in a conduction state, thereby inducing a current to flow through the driving transistor to the sense line via the compensation-switch sub-circuit.

Optionally, the light emitter is a light-emitting diode having the first electrode coupled to the second electrode of the driving transistor and a second electrode coupled to a second power input port.

Optionally, the data-input sub-circuit includes a data-input transistor having a gate electrode coupled to the display scan line configured to receive the first scan signal, a first electrode coupled to the data line configured to receive the data voltage, and a second electrode coupled to the gate electrode of the driving transistor.

Optionally, the compensation-switch sub-circuit includes a compensation-switch transistor having a gate electrode coupled to the compensation scan line configured to receive the second scan signal, a first electrode coupled to the second electrode of the driving transistor, and a second electrode coupled to the sense line.

In another aspect, the present disclosure provides a display apparatus including a display-driving circuit and a driving IC. The driving IC is configured to provide at least a first scan signal, a second scan signal, a data voltage, and a reference voltage to operate the display-driving circuit according to the display-driving method described herein in a display-driving time of each scan cycle for displaying a frame of image and in a blanking time between any two adjacent scan cycles for external data voltage compensation.

Optionally, the display-driving circuit includes a driving transistor having a first electrode coupled to a first power voltage port and a second electrode coupled to a first electrode of a light emitter. The display-driving circuit further includes a data-input sub-circuit coupled to a data line configured to receive a voltage equal to either the reference voltage or the data voltage for displaying a current frame of image, a display scan line configured to receive the first scan signal, and a gate electrode of the driving transistor. Additionally, the display-driving circuit includes a storage capacitor coupled between the gate electrode and the second electrode of the driving transistor. Furthermore, the display-driving circuit includes a compensation-switch sub-circuit coupled to the second electrode of the driving transistor, a sense line, and a compensation scan line configured to receive the second scan signal.

Optionally, the driving IC includes at least one compensation-control sub-circuit coupled to the second electrode of the driving transistor, the sense line, and the data line associated with the display-driving circuit.

Optionally, the data-input sub-circuit includes a data-input transistor having a gate electrode coupled to the display scan line, a first electrode coupled to the data line, and a second electrode coupled to the gate electrode of the driving transistor.

Optionally, the light emitter is a light-emitting diode having the first electrode coupled to the second electrode of the driving transistor and a second electrode coupled to a second power input port.

Optionally, the compensation-switch sub-circuit includes a compensation-switch transistor having a gate electrode coupled to the compensation scan line, a first electrode coupled to the second electrode of the driving transistor, and a second electrode coupled to the sense line.

Optionally, in a display-reset period of the display-driving time of each scan cycle, the first scan signal is supplied at a turn-on voltage level, the second scan signal is supplied at a turn-on voltage level, and a voltage on the data line is initialized at the reference voltage and increased to the data voltage.

Optionally, in an internal-compensation period sequentially after the display-reset period of the display-driving time of each scan cycle, the first scan signal is supplied at the turn-on voltage level, the second scan signal is supplied at a turn-off voltage level, and the data voltage is retained on the data line.

Optionally, in an emission period sequentially after the internal-compensation period of the display-driving time of each scan cycle, the first scan signal is supplied at the turn-off voltage level, and the second scan signal is supplied at the turn-off voltage level.

Optionally, in a start period of the blanking time between two scan cycles, the first scan signal is supplied at the turn-off voltage level, the second scan signal is supplied at the turn-on voltage level, and the driving IC supplies the reference voltage to the second electrode of the driving transistor.

Optionally, in an external-compensation period sequentially after the start period of the blanking time between two scan cycles, the first scan signal is supplied at the turn-off voltage level, the second scan signal is supplied at the turn-on voltage level, and the driving IC controls the second electrode of the driving transistor to a floating state.

Optionally, at an end of the external-compensation period, the driving IC reads a voltage on the sense line and performs a correction to the data voltage for displaying a current frame of image to be supplied to the data line.

Optionally, in a compensation reset period sequentially after the external-compensation period of the blanking time, the first scan signal is supplied at the turn-off voltage level, the second scan signal is supplied at the turn-off voltage level.

BRIEF DESCRIPTION OF THE FIGURES

The following drawings are merely examples for illustrative purposes according to various disclosed embodiments and are not intended to limit the scope of the present invention.

DETAILED DESCRIPTION

The disclosure will now be described more specifically with reference to the following embodiments. It is to be noted that the following descriptions of some embodiments are presented herein for purpose of illustration and description only. It is not intended to be exhaustive or to be limited to the precise form disclosed.

Existing display-driving method with external compensation on the driving transistor drift has issues on short in charging time due to the gate-to-source voltage of the driving transistor being too small resulted from a parasitic capacitance coupling between the gate electrode and the source electrode of a data-input transistor. In this disclosure, all transistors used in a display-driving circuit of a light-emitting display apparatus are devices having similar functions as thin-film transistors or field-effect transistors. For distinguish two electrodes other than the gate electrode of each thin-film transistor, one of them is called a first electrode and another one is called a second electrode. In any implementation of the invention, the first electrode can be a drain electrode and the second electrode can be a source electrode. Or, the first electrode can be a source electrode and the second electrode can be a drain electrode.

Accordingly, the present disclosure provides, inter alia, a method of driving a light-emitting display apparatus, and a display apparatus having the same that substantially obviate one or more of the problems due to limitations and disadvantages of the related art. In one aspect, the present disclosure provides a display-driving method applied to a light emitting display apparatus. In an embodiment, the display-driving method is applied, as an example, to the light-emitting display apparatus based on active matrix organic light emitting diode (AMOLED). Optionally, the display apparatus includes a display panel having a matrix of pixels. Each pixel is configured to emit light via an organic light-emitting diode driven by a display-driving circuit coupled with a driving integrated circuit (IC) built in a display panel thereof.

Figure 1:
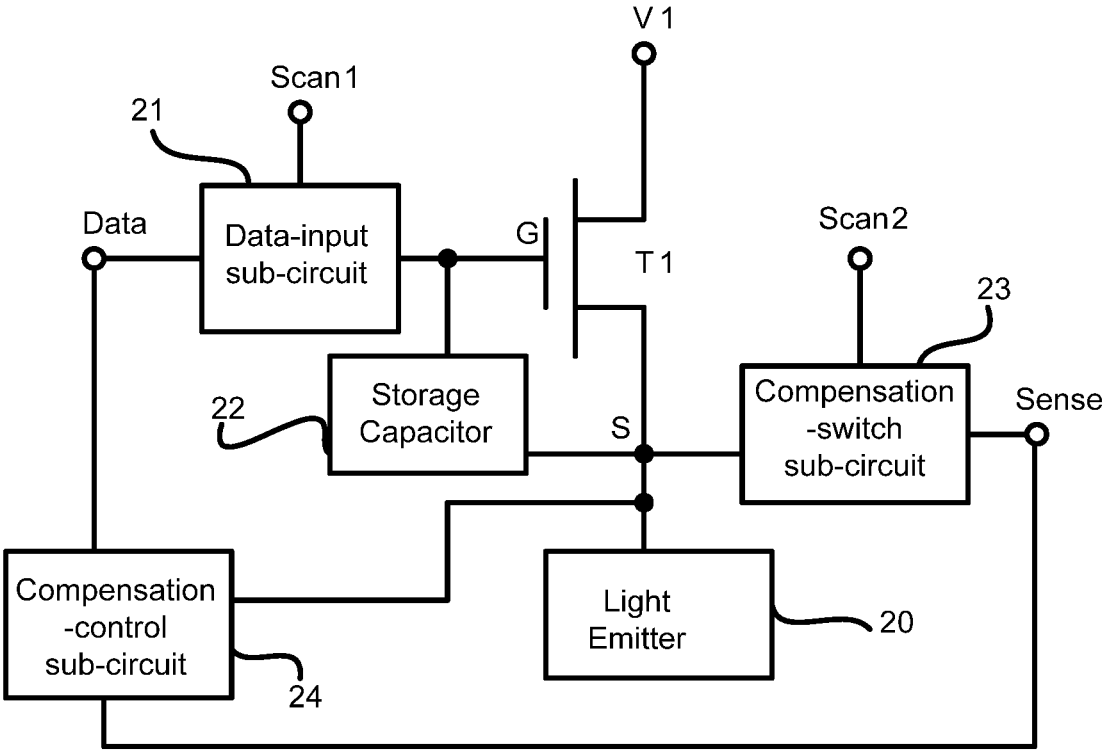
FIG. 1 is block diagram of a display-driving circuit coupled with a compensation-control sub-circuit of a driving IC of a light-emitting display apparatus according to some embodiments of the present disclosure.

FIG. 1 is block diagram of a display-driving circuit coupled with a compensation-control sub-circuit of the driving IC of a light-emitting display apparatus according to some embodiments of the present disclosure. Referring to FIG. 1, the display-driving circuit includes a driving transistor T1 having a first electrode coupled to a first power voltage port V1 and a second electrode coupled to a first electrode of a light emitter 20. Optionally, the driving transistor T1 can be an n-type transistor. Alternatively, the driving transistor T1 can be replaced with a p-type transistor (with proper change in operation conditions) for implementing the display-driving method to be disclosed in disclosure and particularly in the specification below.

Additionally, the display-driving circuit includes a data-input sub-circuit 21 coupled to a data line Data, a display scan line Scan1, and a gate electrode G of the driving transistor T1. The display-driving circuit further includes a storage capacitor 22 coupled between the gate electrode G and the second electrode S of the driving transistor T1. Furthermore, the display-driving circuit includes a compensation-switch sub-circuit 23 coupled to the second electrode S of the driving transistor T1, a sense line Sense, and a compensation scan line Scan2.

In an embodiment, the driving IC of the display apparatus includes a compensation-control sub-circuit 24 coupled to the second electrode S of the driving transistor T1, the sense line Sense, and the data line Data.

Figure 2:
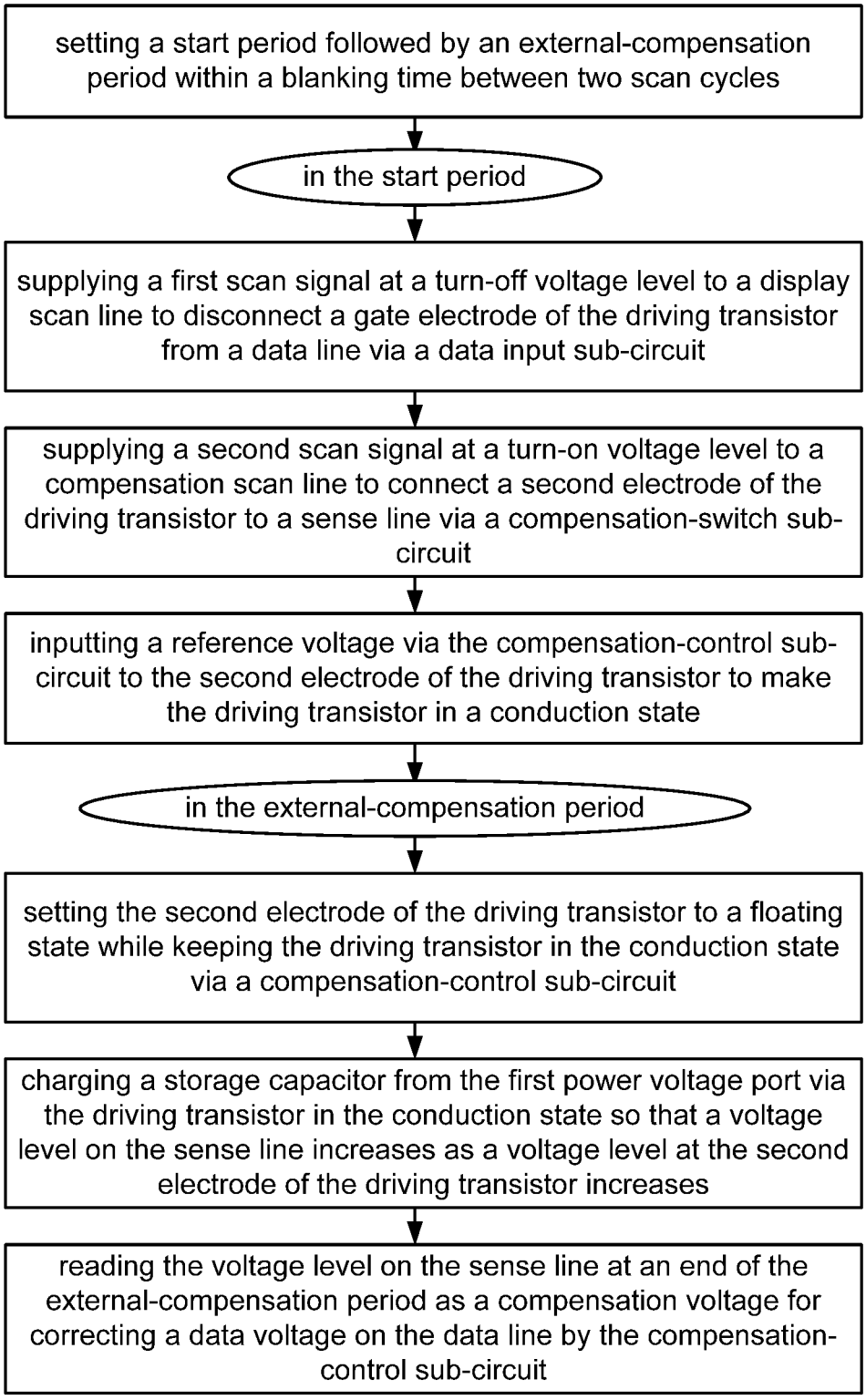
FIG. 2 is a flow chart for illustrating a display-driving method for operating the display-driving circuit of a light-emitting display apparatus according to some embodiments of the present disclosure.

In an embodiment, the display-driving method is executed to drive the matrix of pixels of the display apparatus row-by-row in multiple scan cycles. Each scan cycle corresponds to a display of one frame of image. In an embodiment, the display-driving method is executed not only in a display-driving time of each scan cycle but also in a blanking time between any two adjacent scan cycles. FIG. 2 is a flow chart for illustrating a display-driving method for operating the display-driving circuit coupled with a compensation-control sub-circuit in a light-emitting display apparatus according to some embodiments of the present disclosure. Referring to FIG. 2, the display-driving method includes setting the blanking time to at least a start period followed sequentially by an external-compensation period.

In the start period, the display-driving method includes supplying a first scan signal at a turn-off voltage level to the display scan line Scan1 in both the start period and the external-compensation period to disconnect the gate electrode G of the driving transistor T1 from the data line Data via the data-input sub-circuit 21. Optionally, in an example that all transistors in the display-driving circuit are n-type transistor the turn-off voltage level is a low-voltage level and a turn-on voltage level is a high-voltage level.

Further in the start period, the display-driving method includes supplying a second scan signal at a turn-on voltage level to the compensation scan line Scan2 in both the start period and the external-compensation period to connect the second electrode S of the driving transistor T1 to the sense line Sense via the compensation-switch sub-circuit 23. Furthermore, the method includes inputting a reference voltage Vref via the compensation-control sub-circuit 24 in the driving IC to the second electrode S of the driving transistor T1 to make the driving transistor T1 in a conduction state.

Referring to FIG. 2, also in the external-compensation period, the display-driving method includes setting the second electrode S of the driving transistor T1 to a floating state while keeping the driving transistor T1 in the conduction state via the compensation-control sub-circuit 24. Optionally, the driving IC includes one or more compensation-control sub-circuits. One sense line is configured to couple with one or more compensation-control circuits.

Further in the external-compensation period, the display-driving method includes charging the storage capacitor 22 from the first power voltage port V1 via the driving transistor T1 in the conduction state so that a voltage level on the sense line Sense increases as a voltage level at the second electrode S of the driving transistor T1 increases. Furthermore, the display-driving method includes reading the voltage level on the sense line Sense at an end of the external-compensation period as a compensation voltage for correcting a data voltage on the data line Data by the compensation-control sub-circuit 24.

In some embodiments, the first scan signal supplied to the display scan line Scan1 is kept at a constant voltage during the external-compensation period. This can avoid a problem of short of charging time for external compensation due to a drop of gate-to-source voltage of the driving transistor T1 caused by parasitic capacitance existed between a gate electrode and a source electrode of the transistors in the data-input sub-circuit 21 that is coupled to the driving transistor T1. In other words, the method of the present disclosure is able to make the external compensation independent of the coupling effect of the parasitic capacitance of the gate-source electrodes of the data-input sub-circuit 21 and allow sufficient time for charging the sense line Sense and completing the external compensation by the compensation-control sub-circuit 24.

In a specific embodiment, the processes for correcting the data voltage on the data line Data using the compensation voltage read from the sense line Sense by the compensation-control sub-circuit 24 further include comparing the compensation voltage with a preset emission-driving voltage by the compensation-control sub-circuit 24 to obtain a voltage difference. Then, the processes include correcting the data voltage on the data line Data based on the voltage difference by the compensation-control sub-circuit 24.

In particular, the blanking time between two adjacent scan cycles also includes a compensation-reset period after the external-compensation period. The display-driving method further includes, in the compensation-reset period, supplying the first scan signal at the turn-off voltage level to the display scan line Scan1 to disconnect the gate electrode G of the driving transistor T1 from the data line Data via the data input sub-circuit 21. Additionally, the display-driving method includes supplying the second scan signal at the turn-off voltage level to the compensation scan line Scan2 to disconnect the second electrode S of the driving transistor T1 from the sense line Sense via the compensation-switch sub-circuit 23. The disconnection of the gate electrode G of the driving transistor T1 from the data line Data and the disconnection of the second electrode S of the driving transistor T1 from the sense line Sense allow the display-driving circuit to be ready for a normal display operation in upcoming display-driving time of the next scan cycle.

In some embodiments, the display-driving method also includes, in the compensation-reset period, inputting the reference voltage Vref via the compensation-control sub-circuit 24 to the second electrode S of the driving transistor T1 and the sense line Sense.

Alternatively, in the display-driving time of each scan cycle, several periods are sequentially set, including at least an internal-compensation period followed by an emission period. The display-driving method further includes, in the internal-compensation period, initializing a voltage level at the second electrode S of the driving transistor T1 to the reference voltage Vref. The method further includes supplying the first scan signal at the turn-on voltage level to the display scan line Scan1 to connect the gate electrode G of the driving transistor T1 to the data line Data via the data-input sub-circuit 21. Additionally, the method includes inputting a data voltage on the data line Data intended for displaying a current frame of image to the gate electrode G of the driving transistor T1 to make the driving transistor T1 at a conduction state. Furthermore, the method includes supplying the second scan signal at the turn-off voltage level to the compensation scan line Scan2 to disconnect the second electrode S of the driving transistor T1 from the sense line Sense via the compensation-switch sub-circuit 23 to make the second electrode S of the driving transistor T1 at a floating state. Moreover, the method includes charging the storage capacitor 22 from the first power input port V1 via the driving transistor T1 in the conduction state to change a voltage level at the second electrode S of the driving transistor T1 to be a sum of the reference voltage Vref and an internal-compensation voltage ΔV. The internal-compensation voltage ΔV is dependent upon a carrier mobility of the driving transistor T1.

When operating the display-driving circuit using the display-driving method, since the time associated with the internal-compensation period is very short, for example, about 1 μs, it is not enough to allow the voltage at the second electrode S of the driving transistor T1 to be charged to a level of Vdata−Vth but enough to be charged to a level of Vref+ΔV. Since ΔV is depended on carrier mobility of the driving transistor T1, when the carrier mobility is high, ΔV is large and causes the gate-to-source voltage of the driving transistor T1 to be small during the emission period. When the carrier mobility is low, ΔV is also small and causes the gate-to-source voltage of the driving transistor T1 to be large during the emission period. Thus, the gate-to-source voltage of the driving transistor T1 can be changed based on the carrier mobility thereof, providing a way for reducing the effect of carrier mobility of the driving transistor T1 on emission intensity of the light emitter during the emission period.

In the emission period after the internal-compensation period, the display-driving method includes supplying the first scan signal at the turn-off voltage level to the display scan line Scan1 to disconnect the gate electrode G of the driving transistor T1 from the data line Data via the data-input sub-circuit 21 to make the gate electrode G of the driving transistor T1 to a floating state. Further, the display-driving method includes supplying a second scan signal at the turn-off voltage level to the compensation scan line Scan2 to disconnect the second electrode S of the driving transistor T1 from the sense line Sense via the compensation-switch sub-circuit 23 to make the second electrode S of the driving transistor T1 at the floating state. Furthermore, the method includes maintaining a voltage difference across the storage capacitor 22 a constant so that the driving transistor T1 is at the conduction state with a gate-source voltage $V_{GS}$ of the driving transistor T1 being set to a difference between the data voltage Vdata and the sum of the reference voltage Vref and the internal-compensation voltage ΔV. Moreover, the method includes driving the light emitter to emit light based on a driving current determined by the driving transistor T1 having the gate-source voltage $V_{GS}$.

In a specific embodiment, the display-driving time of each scan cycle includes a display-reset period before the internal-compensation period, when optionally the data voltage on the data line is provided via a data-driving sub-circuit (not shown in FIG. 1). Optionally, the display-driving method also includes, in the display-reset period, setting a voltage level at the second electrode S of the driving transistor T1 at the reference voltage Vref. Then, the method includes supplying the second scan signal at the turn-on voltage level to the compensation scan line Scan2 to connect the second electrode S of the driving transistor T1 to the sense line Sense via the compensation-switch sub-circuit 23 to make a voltage level on the sense line Sense equal to the reference voltage Vref. Additionally, the method includes supplying the first scan signal at the turn-on voltage level to the display scan line Scan1 to connect the gate electrode G of the driving transistor T1 to the data line Data via the data-input sub-circuit 21. Further, the method includes initializing the data line Data with the reference voltage Vref. Optionally, the reference voltage Vref (which is smaller than typical data voltage designed for displaying image) is provided to the data line Data from the data-driving sub-circuit (not shown in FIG. 1). Furthermore, the method includes increasing a voltage level on the data line Data from the reference voltage Vref to a first data voltage indented for displaying a current frame of image. Moreover, the method includes transferring the first data voltage to the gate electrode G of the driving transistor T1 to make the driving transistor T1 in a conduction state, thereby inducing a current to flow through the driving transistor T1 to the sense line Sense via the compensation-switch sub-circuit 23.

Optionally, as each display-driving time of each scan cycle starts, the voltage level on the data line Data is increased from a low voltage level to a high voltage level so that the voltage level written by the data-input sub-circuit 21 to the gate electrode G of the driving transistor T1 is also increased from the low voltage level to the high voltage level. By this way, the Hysteresis effect of thin-film transistor based driving transistor T1 can be avoided.

Figure 3:
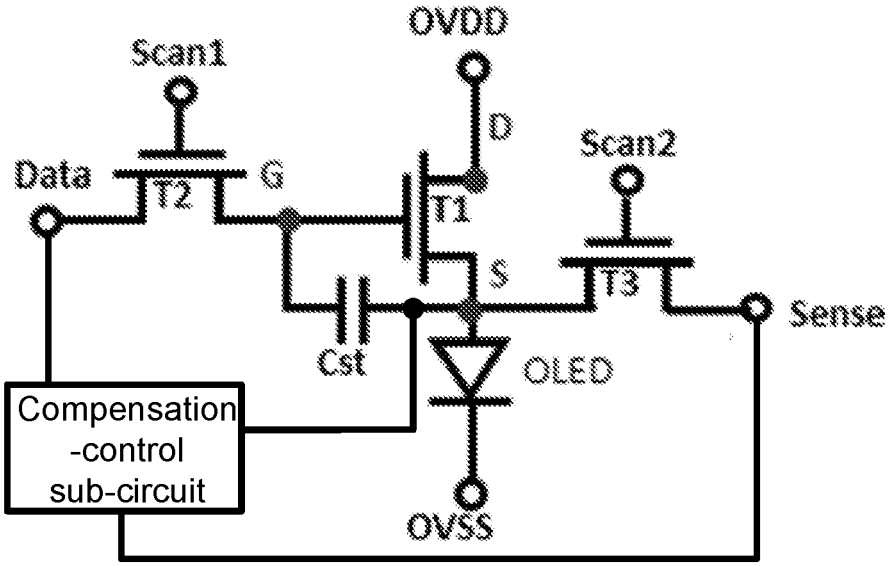
FIG. 3 is circuit diagram of a display-driving circuit to which the display-driving method applies according to an embodiment of the present disclosure.

FIG. 3 is circuit diagram of a display-driving circuit to which the display-driving method applies according to an embodiment of the present disclosure. Referring to FIG. 3, a specific embodiment of the display-driving circuit of FIG. 1 is illustrated for applying the display-driving method of the present disclosure. The specific display-driving circuit of FIG. 3 includes a driving transistor T1, a data-input transistor T2, a capacitor Cst, a compensation-switch transistor T3, and a compensation-control sub-circuit, coupled to a data line Data to receive a reference voltage as an initial voltage thereon or a data voltage used for image display, a first scan line Scan1 to receive a first scan signal, a second scan line Scan2 to receive a second scan signal. The capacitor Cst includes a first electrode coupled to the gate electrode G of the driving transistor T1 and a second electrode coupled to the source electrode S of the driving transistor T1. The compensation-control sub-circuit is coupled respectively to the source electrode S of the driving transistor T1, the sense line Sense, and the data line Data.

Referring to FIG. 3, the drain electrode D of the driving transistor T1 is coupled to a first power input port configured to input a high voltage OVDD. The source electrode S of the driving transistor T1 is coupled to an anode of an organic light emitting diode OLED. The cathode of the OLED is coupled to a second power input port configured to input a low voltage OVSS.

Referring to FIG. 3, the gate electrode of the data-input transistor T2 is coupled to the first scan line Scan1 which is the same as the display scan line in FIG. 1. The drain electrode of the data-input transistor T2 is coupled to the data line Data. The source electrode of the data-input transistor T2 is coupled to the gate electrode G of the driving transistor T1.

Referring to FIG. 3 again, the gate electrode of the compensation-switch transistor T3 is coupled to the second scan line Scan2 which is the same as the compensation scan line in FIG. 1. The drain electrode of the compensation-switch transistor T3 is coupled to the source electrode S of the driving transistor T1. The source electrode of the compensation-switch transistor T3 is coupled to the sense line Sense.

In the example shown in FIG. 3, all transistors are n-type transistors. Optionally, all transistors in the display-driving circuit can be replaced by p-type transistors with proper control signal adjustments.

Figure 4:
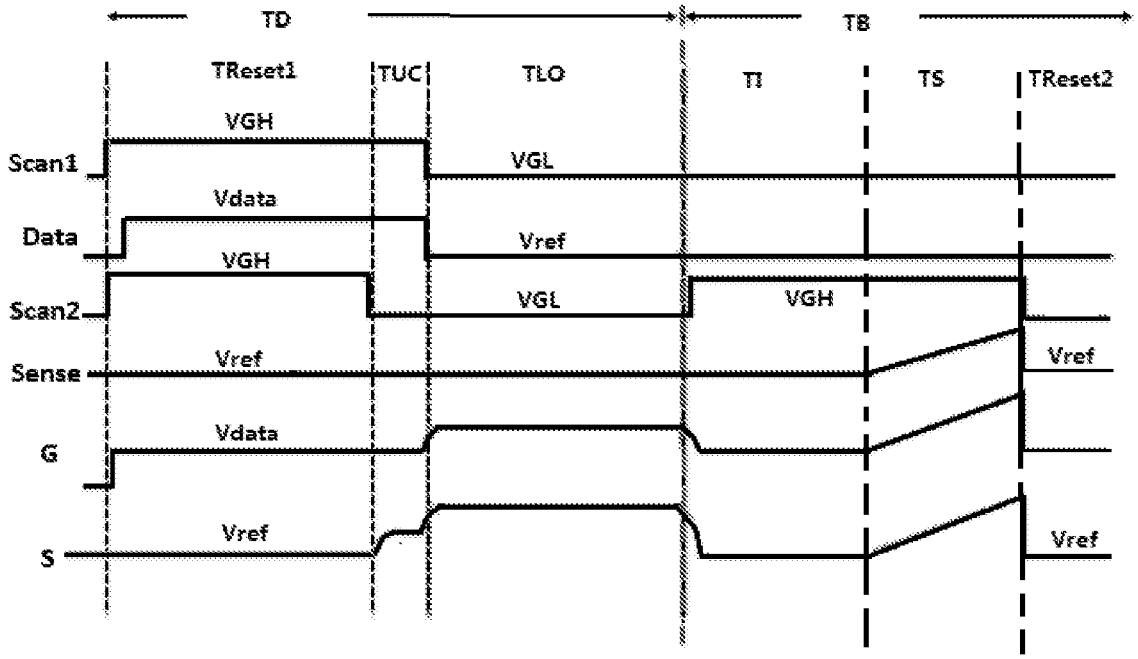
FIG. 4 is a timing diagram of applying the display-driving method to the display-driving circuit according to an embodiment of the present disclosure.

FIG. 4 is a timing diagram of applying the display-driving method to the display-driving circuit according to an embodiment of the present disclosure. Referring to FIG. 4, operation control signals and key node voltages are shown in one scan cycle for displaying image on a light-emitting display apparatus. Each scan cycle is referred to a time for displaying one frame of image, including a display-driving time followed by a blanking time before a next adjacent scan cycle. The display apparatus includes at least a display-driving circuit coupled to a compensation-control sub-circuit as shown in FIG. 1 or as an example shown in FIG. 3.

Referring to FIG. 4, in each scan cycle, the display-driving time includes a display-reset period TReset1. The source electrode S of the driving transistor T1 is set to a reference voltage Vref. A high voltage level signal $V_{GH}$ is supplied to the second scan line Scan2 to make the compensation-switch transistor T3 in a conduction state to connect the source electrode S of the driving transistor T1 with the sense line Sense. Therefore, the voltage level on the sense line also becomes Vref. Also, a high voltage level signal $V_{GH}$ is supplied to the first scan line Scan1 to make the driving transistor T1 in a conduction state to connect the gate electrode G of the driving transistor T1 with the data line Data. Therefore, the voltage level on the data line can be increased from the reference voltage Vref to a first data voltage Vdata configured to display a current frame of image on the display apparatus. When the first data voltage Vdata is inputted from the data line Data to the gate electrode G of the driving transistor T1 to make it in a conduction state, the driving transistor T1 is generating a current flowing through the compensation-switch transistor T3 in the conduction state to the sense line Sense. Since the reference voltage Vref is smaller than Vdata, the voltage level of the gate electrode of the driving transistor T1 is jumped from a low voltage level to a high voltage level. This is to avoid the Hysteresis effect of the driving transistor T1 on image display in emission period.

Referring to FIG. 4, in each scan cycle, the display-driving time also includes an internal-compensation period TUC sequentially after the display-reset period TReset1. The source electrode S of the driving transistor T1 is initialized as a reference voltage Vref. As a high voltage level signal $V_{GH}$ is supplied to the first scan line Scan1, the data-input transistor T2 is in conduction state to connect the gate electrode G of the driving transistor T1 with the data line Data. Now, the data line inputs a second data voltage Vdata designed for displaying a current frame of image to the gate electrode G of the driving transistor T1. The driving transistor accordingly is made in a conduction state. Additionally, a low voltage level signal $V_{GL}$ is supplied to the second scan line Scan2 to disconnect the compensation-switch transistor T3 to further disconnect the source electrode S of the driving transistor T1 from the sense line Sense. Thus, the source electrode S of the driving transistor T1 is set to a floating state. Now, a high voltage OVDD inputted from the first power input port is able to charge the capacitor Cst to make a voltage level of the source electrode S of the driving transistor T1 to a value of Vref+ΔV. The ΔV is an internal compensation voltage depended upon the carrier mobility of the driving transistor T1.

Referring to FIG. 4, in each scan cycle, the display-driving time also includes an emission period TLO sequentially after the internal-compensation period TUC. A low voltage level signal $V_{GL}$ is supplied to the first scan line Scan1 to disconnect the data-input transistor T2. The gate electrode G of the driving transistor T1 is disconnected from the data line Data so that the gate electrode G is in a floating state. A low voltage level signal $V_{GL}$ is also supplied to the second scan line Scan2 to disconnect the compensation-switch transistor T3. The source electrode S of the driving transistor T1 is disconnected from the sense line Sense so that the source electrode S is also in a floating state. The voltage difference across the capacitor Cst from the first electrode to the second electrode is unchanged so that the driving transistor T1 remains in the conduction state. At this time, the gate-source voltage of the driving transistor T1 is maintained at Vdata−Vref−ΔV. This executes an internal compensation to the driving transistor T1, which is able to generate a driving current in this internal-compensation condition to drive the OLED to emit light.

Further referring to FIG. 4, in each scan cycle, the blanking time includes a start period TI. In the start period, a low voltage level signal $V_{GL}$ is also supplied to the first scan line Scan1 to disconnect the gate electrode of T1 from the data line Data. A high voltage level signal $V_{GH}$ is supplied to the second scan line Scan2 to make the compensation-switch transistor T3 in a conduction state so that the source electrode S of T1 is connected to the sense line Sense. The compensation-control sub-circuit is configured to input a reference voltage Vref to the source electrode S of T1 to make the driving transistor T1 in a conduction state.

In each scan cycle, the blanking time further includes an external-compensation period TS sequentially after the start period TI. In the external-compensation period TS, A low voltage level signal $V_{GL}$ is continued to be supplied to the first scan line Scan1 to turn off T2 to disconnect the gate electrode G of T1 from the data line Data. A high voltage level signal $V_{GH}$ is supplied to the second scan line Scan2 to turn on T3 to connect the source electrode S of T1 to the sense line Sense. The compensation-control sub-circuit is configured to control the source electrode S of T1 in a floating state and keep the driving transistor T1 in a conduction state. Now, the high voltage OVDD inputted from the first power input port is able to charge the capacitor Cst via the driving transistor T1 in the conduction state. The charging of Cst increases a voltage level on the sense line Sense as the voltage level at the source electrode S of the driving transistor T1 increases. At an end of the external-compensation period TS, the compensation-control sub-circuit is configured to read the voltage on the sense line Sense as a compensation voltage. Further, the compensation-control sub-circuit is also configured to correct a data voltage on the data line Data based on the compensation voltage.

Referring to FIG. 4 again, in each scan cycle, the blanking time may still include a compensation-reset period TReset2 after the external-compensation period TS. In the compensation-reset period TReset2, a low voltage level signal $V_{GL}$ is supplied to the first scan line Scan1 to turn off T2 to disconnect the gate electrode G of T1 from the data line Data. A low voltage level signal $V_{GL}$ is also supplied to the second scan line Scan2 to turn off T3 to disconnect the source electrode S of T1 from the sense line Sense. This makes the display-driving circuit ready for entering a display-driving time of a next adjacent scan cycle for continuing a next frame of image.

In another aspect, the present disclosure provides a display apparatus. The display apparatus includes a display-driving circuit and a driving integrated circuit (IC). The driving IC is configured to provide at least a first scan signal, a second scan signal, a data voltage, and a reference voltage to operate the display-driving circuit described herein according to the display-driving method described herein in a display-driving time of each scan cycle for displaying a frame of image and in a blanking time between any two adjacent scan cycles for data voltage compensation. Optionally, the driving IC includes one or more memories, one or more processors, and computer-executable programs encoded to all the processes of the display-driving method described herein. The computer-executable programs are stored in the one or more memories and executed in the one or more processors.

In a specific embodiment, the display apparatus is a light-emitting display apparatus having a light emitter coupled to the display-driving circuit to receive a driving current to emit light for display image. The display-driving circuit includes a driving transistor having a first electrode coupled to a first power input port, a second electrode coupled to the light emitter. The display-driving circuit further includes data-input sub-circuit respectively coupled to a data line, a display scan line, and a gate electrode of the driving transistor. Additionally, the display-driving circuit includes a storage capacitor having a first electrode coupled to the gate electrode of the driving transistor and a second electrode coupled to the second electrode of the driving transistor. Furthermore, the display-driving circuit includes a compensation-switch sub-circuit respectively coupled to the second electrode of the driving transistor, a sense line, and a compensation scan line. In the embodiment, the driving IC includes a compensation-control sub-circuit respectively coupled to the second electrode of the driving transistor, the sense line, and the data line. In particular, the data-input sub-circuit includes a data-input transistor with its gate electrode being coupled to the display scan line, its first electrode being coupled to the data line, and its second electrode being coupled to the gate electrode of the driving transistor. The compensation-switch sub-circuit includes a compensation-switch transistor having a gate electrode coupled to the compensation scan line, a first electrode coupled to the second electrode of the driving transistor, and a second electrode coupled to the sense line.

Optionally, one sense line of the display apparatus can be coupled with one or more display-driving circuits to allow multiple subpixels (each is associated with one display-driving circuit) to share one sense line for saving conduction line layout space. Optionally, the display apparatus includes multiple switch-control sub-circuits. Each switch-control sub-circuit is connected between one sense line and multiple display-driving circuits. During the external-compensation period, the switch-control sub-circuit is able to set divisional times for the sense line to separately connect with one or more display-driving circuits for performing respective external compensations at each divisional time.

The foregoing description of the embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to exemplary embodiments of the invention does not imply a limitation on the invention, and no such limitation is to be inferred. The invention is limited only by the spirit and scope of the appended claims. Moreover, these claims may refer to use "first", "second", etc. following with noun or element. Such terms should be understood as a nomenclature and should not be construed as giving the limitation on the number of the elements modified by such nomenclature unless specific number has been given. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A display-driving method for a light-emitting display apparatus, the light-emitting display apparatus comprises a driving integrated circuit (IC) and a display-driving circuit;

wherein the display-driving circuit comprises:

a driving transistor having a first electrode coupled to a first power input port and a second electrode coupled to a first electrode of a light emitter;

a data-input sub-circuit coupled to a data line, a display scan line, and a gate electrode of the driving transistor;

a storage capacitor coupled between the gate electrode and the second electrode of the driving transistor;

a compensation-switch sub-circuit coupled to the second electrode of the driving transistor, a sense line, and a compensation scan line;

wherein the driving IC comprises:

a compensation-control sub-circuit coupled to the second electrode of the driving transistor, the sense line, and the data line;

the display-driving method comprising:

setting a start period followed by an external-compensation period within a blanking time between two scan cycles respectively for displaying two frames of image;

in the start period, supplying a first scan signal at a turn-off voltage level to the display scan line to disconnect the gate electrode of the driving transistor from the data line via the data-input sub-circuit;

supplying a second scan signal at a turn-on voltage level to the compensation scan line to connect the second electrode of the driving transistor to the sense line via the compensation-switch sub-circuit; and inputting a reference voltage via the compensation-control sub-circuit to the second electrode of the driving transistor to make the driving transistor in a conduction state;

wherein the blanking time further includes a compensation-reset period after the external-compensation period, the display-driving method in the compensation-reset period further comprising:

supplying the first scan signal at the turn-off voltage level to the display scan line to disconnect the gate electrode of the driving transistor from the data line via the data input sub-circuit; and supplying the second scan signal at the turn-off voltage level to the compensation scan line to disconnect the second electrode of the driving transistor from the sense line via the compensation-switch sub-circuit.

2. The method of claim 1, further comprising:

in the external-compensation period, supplying the first scan signal at the turn-off voltage level to the display scan line to disconnect the gate electrode of the driving transistor from the data line via the data input sub-circuit;

supplying the second scan signal at the turn-on voltage level to the compensation scan line to connect the second electrode of the driving transistor to the sense line via the compensation-switch sub-circuit;

making the second electrode of the driving transistor to a floating state via the compensation-control sub-circuit while keeping the driving transistor in the conduction state;

charging the storage capacitor from the first power voltage port via the driving transistor in the conduction state so that a voltage level on the sense line increases as a voltage level at the second electrode of the driving transistor increases; and reading the voltage level on the sense line at an end of the external-compensation period as a compensation voltage for correcting a data voltage on the data line by the compensation-control sub-circuit.

3. The method of claim 2, further comprising:

comparing the compensation voltage with a preset emission-driving voltage by the compensation-control sub-circuit to obtain a voltage difference; and correcting the data voltage on the data line based on the voltage difference by the compensation-control sub-circuit.

4. The method of claim 1, wherein in the compensation-reset period further comprising inputting the reference voltage via the compensation-control sub-circuit to the second electrode of the driving transistor and the sense line.

5. The method of claim 4, wherein each scan cycle includes a display-driving time including an internal-compensation period followed by an emission period, the display-driving method in the internal-compensation period further comprising:

initializing a voltage level at the second electrode of the driving transistor to the reference voltage;

supplying the first scan signal at the turn-on voltage level to the display scan line to connect the gate electrode of the driving transistor to the data line via the data-input sub-circuit;

inputting a data voltage on the data line for displaying a current frame of image to the gate electrode of the driving transistor to make the driving transistor at a conduction state;

supplying the second scan signal at the turn-off voltage level to the compensation scan line to disconnect the second electrode of the driving transistor from the sense line via the compensation-switch sub-circuit to make the second electrode of the driving transistor at a floating state; and charging the storage capacitor from the first power input port via the driving transistor in the conduction state to change a voltage level at the second electrode of the driving transistor to be a sum of the reference voltage and an internal-compensation voltage;

the display-driving method in the emission period further comprising:

supplying the first scan signal at the turn-off voltage level to the display scan line to disconnect the gate electrode of the driving transistor from the data line via the data-input sub-circuit to make the gate electrode of the driving transistor to a floating state;

supplying a second scan signal at the turn-off voltage level to the compensation scan line to disconnect the second electrode of the driving transistor from the sense line via the compensation-switch sub-circuit to make the second electrode of the driving transistor at the floating state;

maintaining a voltage difference across the storage capacitor a constant so that the driving transistor is at the conduction state with a gate-source voltage of the driving transistor being set to a difference between the data voltage and the sum of the reference voltage and the internal-compensation voltage; and driving the light emitter to emit light based on a driving current determined by the driving transistor having the gate-source voltage.

6. The method of claim 5, wherein the display-driving time further includes a display-reset period before the internal-compensation period, the display-driving method in the display-reset period further comprising:

setting a voltage level at the second electrode of the driving transistor at the reference voltage;

supplying the second scan signal at the turn-on voltage level to the compensation scan line to connect the second electrode of the driving transistor to the sense line via the compensation-switch sub-circuit to make a voltage level on the sense line equal to the reference voltage;

supplying the first scan signal at the turn-on voltage level to the display scan line to connect the gate electrode of the driving transistor to the data line via the data-input sub-circuit;

initializing the data line with the reference voltage;

increasing a voltage level on the data line from the reference voltage to a first data voltage indented for displaying a current frame of image; and transferring the first data voltage to the gate electrode of the driving transistor to make the driving transistor in a conduction state, thereby inducing a current to flow through the driving transistor to the sense line via the compensation-switch sub-circuit.

7. The method of claim 1, wherein the light emitter is a light-emitting diode having the first electrode coupled to the second electrode of the driving transistor and a second electrode coupled to a second power input port.

8. The method of claim 1, wherein the data-input sub-circuit comprises a data-input transistor having a gate electrode coupled to the display scan line configured to receive the first scan signal, a first electrode coupled to the data line configured to receive the data voltage, and a second electrode coupled to the gate electrode of the driving transistor.

9. The method of claim 1, wherein the compensation-switch sub-circuit comprises a compensation-switch transistor having a gate electrode coupled to the compensation scan line configured to receive the second scan signal, a first electrode coupled to the second electrode of the driving transistor, and a second electrode coupled to the sense line.

10. A display apparatus comprising a display-driving circuit and a driving integrated circuit (IC), wherein the driving IC is configured to provide at least a first scan signal, a second scan signal, a data voltage, and a reference voltage to operate the display-driving circuit according to the display-driving method of claim 1 in a display-driving time of each scan cycle for displaying a frame of image and in a blanking time between any two adjacent scan cycles for external data voltage compensation;

wherein, in a display-reset period of the display-driving time of each scan cycle, the first scan signal is supplied at a turn-on voltage level, the second scan signal is supplied at a turn-on voltage level, and a voltage on the data line is initialized at the reference voltage and increased to the data voltage; in an internal-compensation period sequentially after the display-reset period of the display-driving time of each scan cycle, the first scan signal is supplied at the turn-on voltage level, the second scan signal is supplied at a turn-off voltage level, and the data voltage is retained on the data line; and in an emission period sequentially after the internal-compensation period of the display-driving time of each scan cycle, the first scan signal is supplied at the turn-off voltage level, and the second scan signal is supplied at the turn-off voltage level.

11. The display apparatus of claim 10, wherein the display-driving circuit comprises a driving transistor having a first electrode coupled to a first power voltage port and a second electrode coupled to a first electrode of a light emitter; the display-driving circuit further comprises a data-input sub-circuit coupled to a data line configured to receive a voltage equal to either the reference voltage or the data voltage for displaying a current frame of image, a display scan line configured to receive the first scan signal, and a gate electrode of the driving transistor; additionally, the display-driving circuit comprises a storage capacitor coupled between the gate electrode and the second electrode of the driving transistor; furthermore, the display-driving circuit comprises a compensation-switch sub-circuit coupled to the second electrode of the driving transistor, a sense line, and a compensation scan line configured to receive the second scan signal.

12. The display apparatus of claim 11, wherein the driving IC comprises at least one compensation-control sub-circuit coupled to the second electrode of the driving transistor, the sense line, and the data line associated with the display-driving circuit.

13. The display apparatus of claim 11, wherein the data-input sub-circuit comprises a data-input transistor having a gate electrode coupled to the display scan line, a first electrode coupled to the data line, and a second electrode coupled to the gate electrode of the driving transistor.

14. The display apparatus of claim 11, wherein the light emitter is a light-emitting diode having the first electrode coupled to the second electrode of the driving transistor and a second electrode coupled to a second power input port.

15. The display apparatus of claim 11, wherein the compensation-switch sub-circuit comprises a compensation-switch transistor having a gate electrode coupled to the compensation scan line, a first electrode coupled to the second electrode of the driving transistor, and a second electrode coupled to the sense line.

16. A display apparatus comprising a display-driving circuit and a driving IC, wherein the driving IC is configured to provide at least a first scan signal, a second scan signal, a data voltage, and a reference voltage to operate the display-driving circuit according to the display-driving method of claim 1 in a display-driving time of each scan cycle for displaying a frame of image and in a blanking time between any two adjacent scan cycles for external data voltage compensation;

wherein, in a start period of the blanking time between two scan cycles, the first scan signal is supplied at the turn-off voltage level, the second scan signal is supplied at the turn-on voltage level, and the driving IC supplies the reference voltage to the second electrode of the driving transistor; in an external-compensation period sequentially after the start period of the blanking time between two scan cycles, the first scan signal is supplied at the turn-off voltage level, the second scan signal is supplied at the turn-on voltage level, and the driving IC controls the second electrode of the driving transistor to a floating state; at an end of the external-compensation period, the driving IC reads a voltage on the sense line and performs a correction to the data voltage for displaying a current frame of image to be supplied to the data line; and in a compensation reset period sequentially after the external-compensation period of the blanking time, the first scan signal is supplied at the turn-off voltage level, the second scan signal is supplied at the turn-off voltage level.

* * * * *